US005094355A

United States Patent [19]

Clark et al.

[11] Patent Number: 5,094,355

[45] Date of Patent: Mar. 10, 1992

[54] HINGED-LID FOOD CONTAINER WITH SEALABLE COMPARTMENTS EMPLOYING FRONT AND SIDE LATCHING MEANS

[75] Inventors: Terry A. Clark, Rochester; Richard T. Warburton, Canandaigua, both of N.Y.

[73] Assignee: Mobil Oil Corporation, Fairfax, Va.

[21] Appl. No.: 633,720

[22] Filed: Dec. 20, 1990

[51] Int. Cl.[5] ..... B65D 1/36

[52] U.S. Cl. ..... 220/4.23; 220/4.22; 220/523; 220/526; 229/2.5 R; 206/564

[58] Field of Search ..... 206/470, 541, 564; 229/2.5 R; 220/306, 337, 339, 4.22, 4.23, 523, 526

[56] References Cited

U.S. PATENT DOCUMENTS

| | | | |
|---|---|---|---|
| 3,633,785 | 1/1972 | Cyr | 229/2.5 R |
| 3,675,811 | 7/1972 | Artz | 229/2.5 R |
| 3,795,360 | 3/1974 | Bianchi et al. | 220/306 |
| 3,902,540 | 9/1975 | Commisso | 229/2.5 R |
| 3,915,251 | 11/1975 | Payne | 220/306 |
| 3,935,962 | 2/1976 | Schubert et al. | 220/306 |
| 4,057,169 | 11/1977 | Payne | 220/306 |
| 4,081,646 | 3/1978 | Goltsos | 219/10.55 |
| 4,127,189 | 11/1978 | Shumrak et al. | 220/339 |
| 4,132,344 | 1/1979 | Jewell | 229/2.5 R |
| 4,193,496 | 3/1980 | Barratt | 220/306 |
| 4,201,301 | 5/1980 | Aggio | 229/2.5 R |
| 4,234,097 | 11/1980 | Daenen | 220/4 D |
| 4,253,600 | 3/1981 | Schubert | 229/2.5 R |
| 4,294,371 | 10/1981 | Davis | 229/2.5 R |
| 4,298,133 | 11/1981 | Davis | 220/306 |
| 4,440,303 | 4/1984 | Seager | 206/509 |
| 4,466,552 | 8/1984 | Butterworth et al. | 220/306 |
| 4,494,650 | 1/1985 | Cullen | 229/2.5 R |
| 4,535,889 | 8/1985 | Terauds | 229/2.5 R |
| 4,545,487 | 10/1985 | Asmus | 206/508 |
| 4,648,511 | 3/1987 | Ritman | 206/541 |
| 4,653,685 | 3/1987 | Leary et al. | 229/2.5 |
| 4,883,195 | 11/1989 | Ott et al. | 220/339 |
| 4,974,738 | 12/1990 | Kidd et al. | 220/4 E |

FOREIGN PATENT DOCUMENTS

| | | | |
|---|---|---|---|
| 1187045 | 5/1985 | Canada | 229/2.5 R |
| 2118142 | 10/1983 | United Kingdom | 229/2.5 R |

*Primary Examiner*—David T. Fidei

*Attorney, Agent, or Firm*—Alexander J. McKillop; Charles J. Speciale; Michael J. Mlotkowski

[57] ABSTRACT

A hinged-lid food container having sealable compartments for the discrete storage and dispensing of a plurality of various comestibles, in which a cover member is adapted to sealingly isolate each compartment in the closed condition of the container. The container comprises a tray member having a plurality of compartments separated by upstanding wall portions, a bottom wall structure and a peripheral sidewall forming an encompassing tray rim; a cover member hingedly joined to the tray member along a portion of the tray rim, the cover member having a peripheral depending wall structure engageable with the tray rim to form a closed container arrangement; and depending rib means formed in the cover member engageable with the surfaces of the upstanding wall portions of the tray compartments for sealing the compartments in the closed condition of the container; wherein the cover member and the tray member each include peripheral flange portions, at least one latching means being formed in the peripheral flange portion of the tray member for receiving the corresponding flange portion of the cover member in the closed condition of the container so as to provide a sealed container structure.

10 Claims, 3 Drawing Sheets

HINGED-LID FOOD CONTAINER WITH SEALABLE COMPARTMENTS EMPLOYING FRONT AND SIDE LATCHING MEANS

FIELD OF THE INVENTION

The present invention relates to a compartmented food container, and more particularly, relates to a multi-compartmented container for the discrete storage and dispensing of a plurality of various comestibles, in which a cover member is adapted to sealingly isolate each compartment in the closed condition of the container.

BACKGROUND OF THE INVENTION

In recent years, single use or disposable containers for the storage, transport and serving of various comestibles, whereby the containers are constituted from a thermoplastic material, such as foamed polystyrene or the like, have come into widespread use in various institutions, so called "take-out" restaurants and "fast-food" retail establishments. These containers generally incorporate a tray member adapted to receive the comestibles, and a superimposable cover structure hingedly connected to the tray member to enable the contents of the container to be sealed during transportation and storage, and in many instances allows for maintaining specific temperature conditions of the container contents. The widespread acceptance of such containers by consumers has lead to their development to incorporate a plurality of compartments for the discrete storage and/or serving of different types of food items; such as a main course from one container compartment, a vegetable or the like from another container compartment, and possibly a dessert or salad from a said in a further container compartment, or the like. Containers of that type are extremely popular inasmuch as they allow for the storage and serving of entire meals therefrom without having to resort to an array of separate containers for serving the individual food items or comestibles of a meal.

Among the problems which have been encountered in the storage of food items in a single container having a plurality of compartments, each of which is intended to receive a different type of food item or comestible, are the difficulties in maintaining such items separated from each other during the storage and transport of the containers from one location to another, such as from the retail or "fast-food" establishment towards a location where the container contents are to be consumed, inasmuch as this may quite frequently entail tipping and shaking, or even inverting of the container, thereby causing the compartmented container contents to intermingle and possibly rendering the foods unattractive if not completely unpalatable to a prospective consumer.

In order to ameliorate the problem of spillage of food items from one compartment to another when the container is in a closed condition and while it is being transported or moved about in different orientations, structure has been proposed in the form of either an internal lid closing off the compartments beneath the cover or, alternatively, the cover portion of the container itself may be provided with suitable depending wall or rib structure which, when the cover is closed over the tray member will contact the upstanding walls of the compartments in generally sealing engagement so as to inhibit foods contained in the individual compartments from commingling with the contents of other compartments in the container. This, in effect, will considerably enhance the versatility of such containers and render them adaptable for the storage, conveyance and serving of different types of foods from compartments in the same container. Moreover, the container may also be constituted from a suitable material, such as foamed thermoplastic, as polyethylene, polystyrene or the like, which will ensure that the food items contained in each of the various compartments maintain their respective temperatures. For instance, one compartment may contain hot food, whereas an adjoining compartment may contain a cold food item, with each of the compartmented foods being essentially in a thermally sealed-off relationship relative to the other compartments of the container. Additionally, the material of the container may lend itself to use in a microwave oven by being constituted of a material which is transparent to microwave energy, thereby enabling the heating of the food items while in the closed container, thereby again rendering the container contents more palatable and attractive to a prospective consumer.

Numerous containers of the type described herein are currently being marketed for purposes of storing, heating and discretely serving a plurality of food items or comestibles separately stored in various compartments of such containers.

For example, U.S. Pat. No. 4,081,646, discloses a multi-compartmented container enabling the storage of different types of foods in compartments which are separated from each other by formations of upstanding wall portions in a tray member. A cover member which is hingedly connected to the compartmented tray member containing the food items includes depending ribs which are in the form of depending walls engaging into the respective compartments so as to prevent contact between the compartment walls and the foods, the latter of which are generally in a frozen condition. Thereafter, the container is adapted to be exposed to microwave energy in a microwave oven while in an inverted condition, preferably within an outer receptacle incorporating wall portions which are transparent to microwave energy so as to enable heating the food, and then the container is reversed into its upright position, the cover member lifted open and removed from the container. This will enable the food items to be maintained in the compartments without contacting the wall surfaces thereof in a supposedly unsightly manner, thereby rendering the contents more palatable to a consumer. However, the construction of a multi-compartmented container as described in this patent is relatively complex and necessitates an extremely close accuracy in the dimensioning of the depending wall structure of the cover to enable to sealingly engage the inner surfaces of each of the tray compartments to prevent leakage of any sauces or gravies between and contact with the cooperating wall structures. Consequently, the container structure is extremely expensive and complex in manufacture and renders the containers uneconomical from the standpoint of mass production and disposable applications in so-called "take-out" or "fast-food" retail operations.

U.S. Pat. No. 4,653,685, describes a dual compartmented sandwich package in which wall structure provided on a container cover portion will separate tray compartments so as to permit hot and cold foods contained in each respective compartment to be maintained in a separated condition.

Other containers which enable the separation of foods and similar types of items contained therein are also known. For example, U.S. Pat. No. 4,234,097 discloses a serving plate set having two similar receptacles which in one form is separated by a sealing member that segregates the receptacle contents, such member also being of a plate-like configuration and which in another form employs the two receptacles to create a closured container.

U.S. Pat. No. 4,440,303 relates to an improved insulated tray having both of its top and bottom surfaces configured so that either may receive food articles. The configuration is such that the trays may be stacked one upon the other in a wide variety of configurations. When so stacked, the depressions in the upper tray serve to provide a closure for the depressions in the lower tray.

U.S. Pat. No. 4,545,487 relates to a food serving tray which has a hood shaped to define a generally planar upper surface along with a downwardly depending first marginal skirt. A generally planar lid has an upwardly projecting second marginal skirt that is bonded to the first skirt. A food support is also of generally planar shape and has a downwardly depending third marginal skirt that is bonded to an upwardly projecting fourth marginal skirt of a likewise generally planar base. The lid is indexed so as to lie in mating relationship atop the support. A liner desirably covers the support.

Although these publications describe multi-compartmented containers of various types, none of these are actually adapted for use in so-called "fast-food" operations enabling their economical applications and ready disposability after a single use by a consumer. U.S. patent application Ser. No. 07/555,228, filed on Jul. 19, 1990, the inventors of which are also the inventors of the present invention, discloses such a container. The container described therein, comprises a tray member having a plurality of compartments separated by upstanding wall portions, a bottom wall structure and a peripheral sidewall forming an encompassing tray rim; a cover member hingedly joined to the tray member along a portion of the tray rim, the cover member having a peripheral depending wall structure engageable with the tray rim to form a closed container arrangement; and depending rib means formed in the cover member engageable with the surfaces of the upstanding wall portions of the tray compartments for sealing the compartments the container is in the closed condition. In a preferred embodiment of the container disclosed in Ser. No. 07/555,228, the cover member and tray member each are provided with peripheral flange portions, the tray member having a peripheral recess formed in its flange portion for the purpose of receiving the flange portion of the cover member in the closed condition of the container so as to assist in providing a sealed container structure. In a more preferred embodiment of the compartmented container of Ser. No. 07/555,228, the flange portion of the cover member is provided with tabs along an edge opposite the hinged connection between the tray and cover, with slit means in the flange portion of the tray member cooperatively engageable by the tabs for releasably latching the container in a closed condition.

While the container of Ser. No. 07/555,228, provides an effective structure, addressing the problem of food item spillage between container compartments when closed and moved about, and is particularly well-suited for use in fast-food operations, a need still exits for a container which provides enhanced sealing characteristics for use in fast-food operations.

SUMMARY OF THE INVENTION

Accordingly, in order to obviate the above-described limitations and disadvantages, the present invention provides a hinged-lid food container having sealable compartments for the discrete storage and dispensing of a plurality of various comestibles, in which a cover member is adapted to sealingly isolate each compartment in the closed condition of the container. The container comprises a tray member having a plurality of compartments separated by upstanding wall portions, a bottom wall structure and a peripheral sidewall forming an encompassing tray rim; a cover member hingedly joined to the tray member along a portion of the tray rim, the cover member having a peripheral depending wall structure engageable with the tray rim to form a closed container arrangement; and depending rib means formed in the cover member engageable with the surfaces of the upstanding wall portions of the tray compartments for sealing the compartments in the closed condition of the container; wherein the cover member and the tray member each include peripheral flange portions, at least one latching means being formed in the peripheral flange portion of the tray member for receiving the corresponding flange portion of the cover member in the closed condition of the container so as to provide a sealed container structure.

It is therefore an object of the present invention to provide a multi-compartmented food container in which a tray member includes a plurality of separate compartments having upstanding wall portions, and a cover member hingedly connected with the tray member and including depending wall structure therein which will overlap the outer surfaces of the compartment walls of the tray member so as to cause the compartment to be essentially sealed relative to each other in the closed condition of the container.

Still another object of the present invention is to provide a simple multi-compartmented food container of the type described in which the compartments are sealed in the closed condition of the container, which is constituted from a foamable thermoplastic material, is extremely simple in construction and economically disposable after only a single use by a consumer.

Furthermore, it is another object of the present invention to provide a container incorporating a plurality of compartments for the discrete storage and serving of various food items which are essentially thermally sealed separated relative to each other in the closed condition of the compartment, and in which the container is of a material which is transparent to microwave energy so as to enable the container contents to be heated therein in a microwave oven.

Other objects and the several advantages of the present invention will become apparent to those skilled in the art upon a reading of the specification and the claims appended thereto.

BRIEF DESCRIPTION OF THE DRAWINGS

Reference may now be had to the following detailed description of an exemplary embodiment of a multi-compartmented food container constructed pursuant to the invention; in which.

DETAILED DESCRIPTION OF THE INVENTION

Figure 1:
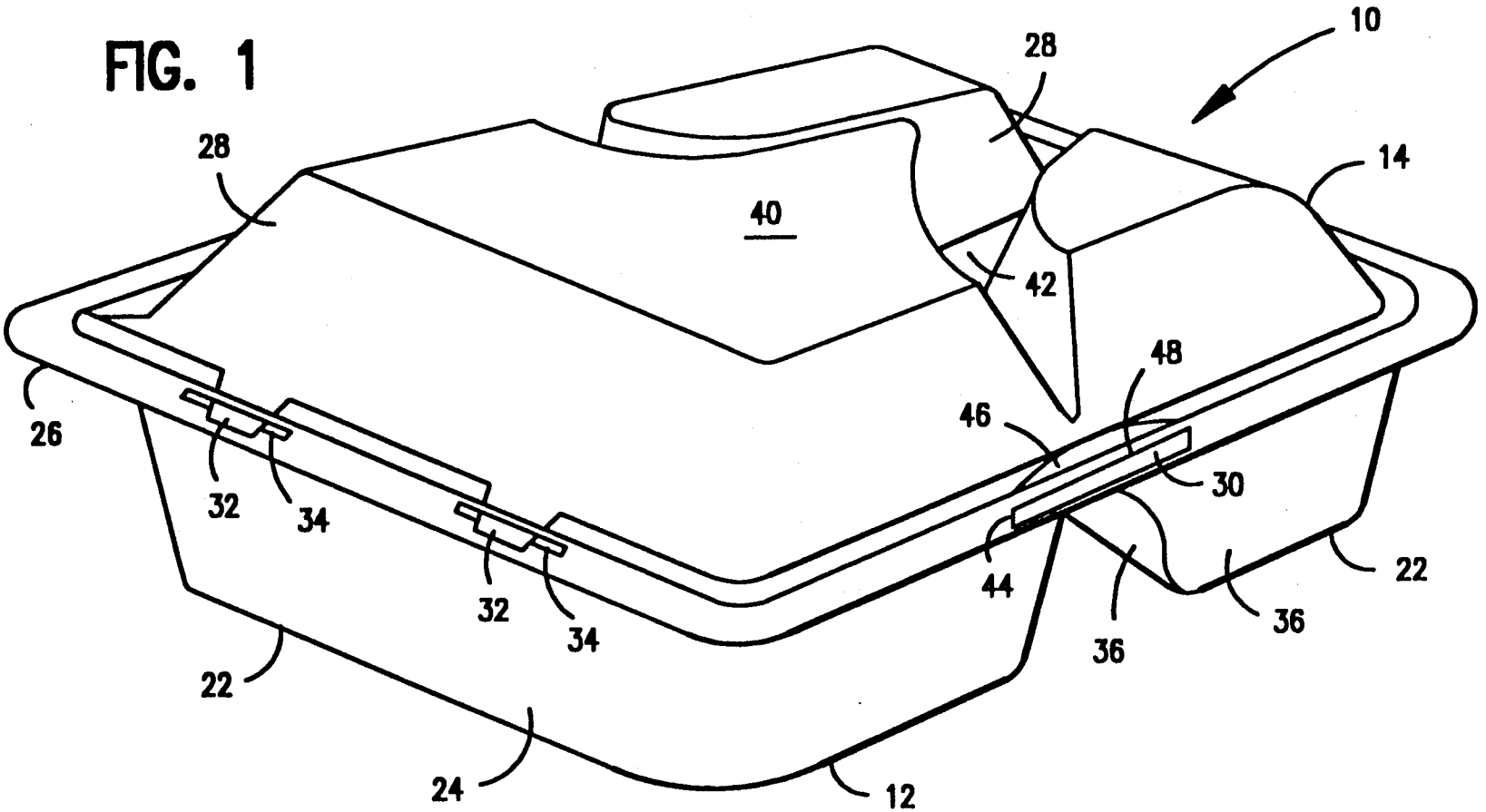
FIG. 1 illustrates a perspective view of the inventive container shown in a closed condition.
Figure 2:
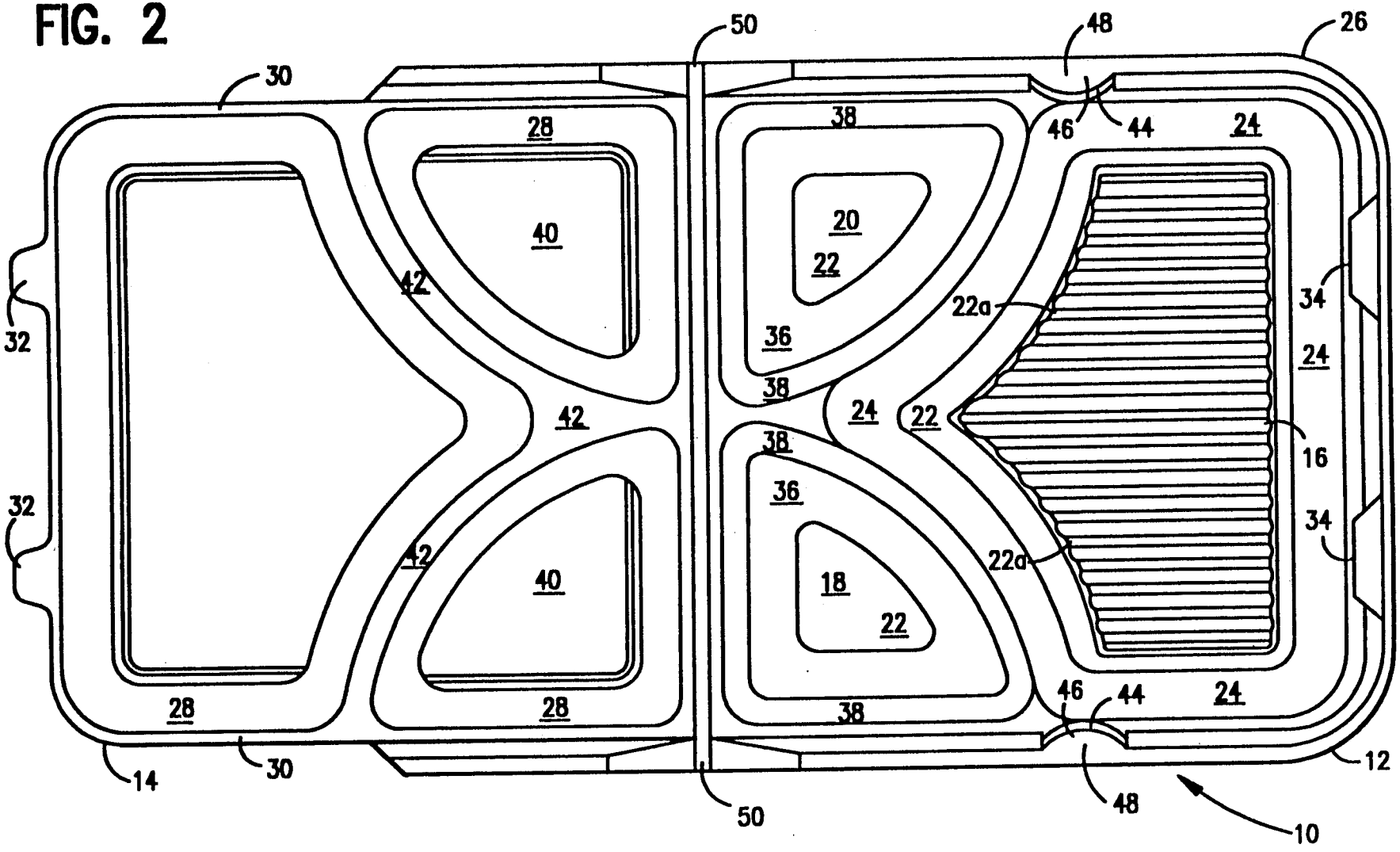
FIG. 2 illustrates a top plan view of the inventive container shown in an open condition.
Figure 4:
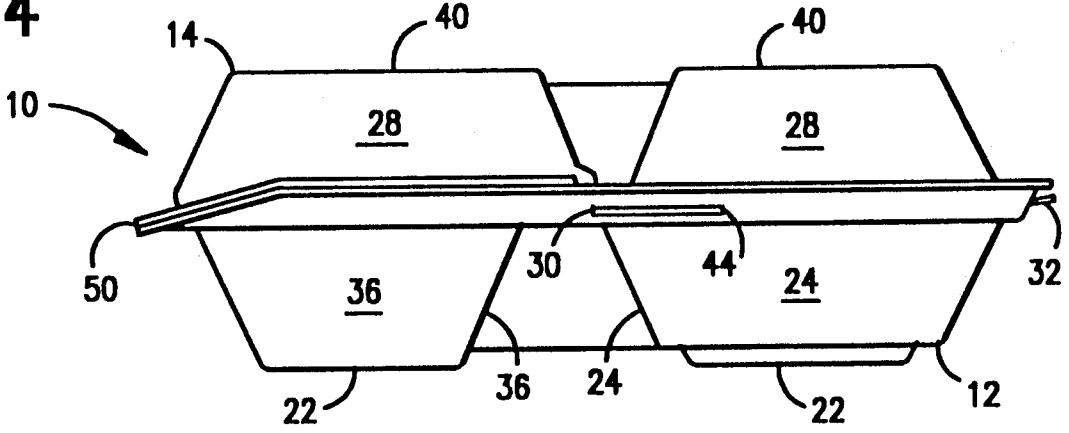
FIG. 4 illustrates a side view of the container depicted in FIG. 2 in a closed condition.

Referring now in detail to the drawings of FIGS. 1 through 4, there is illustrated a container 10 of generally rectangular shape, which includes a tray member 12 adapted to receive foods, and a cover member 14 hingedly joined to or integrally formed with the tray member 12 so as to be pivotable between a container closed condition as shown in FIG. 1; or an open condition as shown in FIG. 2, in which access to the contents of the tray member 12 of the container 10 is afforded to a consumer.

The container 10 has the tray member 12 separated into a plurality of compartments 16, 18 and 20, as described hereinbelow, and wherein the tray member 12 includes a substantially flat bottom wall structure 22, and upwardly and outwardly diverging sidewalls 24 and 36 which at their other upper ends, excepting where the tray member 12 is hinged to the cover member 14, extend radially outwardly into a peripheral generally horizontal flange structure 26.

Similarly, the cover member 14 which is hinged to an edge at one side of the tray member 12 includes a substantially flat top surface wall 40 and depending and outwardly diverging wall portions 28 which at the ends coplanar with the hinged connection 50 of the cover member 14 with the tray member 12, extend into peripheral horizontal radially outwardly extending flange structure 30. The edge of the flange structure 30 on cover member 14 which is located opposite that of the hinge connection 50 with the tray member 12 is provided with a pair of protruding tab members 32 adapted to releasably engage into cooperating slits 34 formed in the flange of the tray member 12 so as to provide a locking tab arrangement when the container 10 is in a closed position, as is known in the art.

The inventive structure of the container 10 incorporates the plurality of compartments 16, 18 and 20 in the tray member 12 in that a pair of the compartments are formed into the tray bottom wall 22 in the shape of upstanding wall portions 36, with essentially beaded upper ends 38 extending co-planar with the encompassing flange structure 28 on the tray member 12. Thus, the illustrated larger compartment 16 in the tray member 12 may be adapted to receive a major or heavier portion of a food item, and in order to impart additional stiffness and rigidity to the tray member 12, may be of a rib-like wavilinear configuration 22*a*. This will provide a strengthened bottom over a major bottom surface portion of the tray member 12. Similarly, the cover member 14 has a flat top surface 40 which has ribs molded therein of generally the shape of raised wall members 42 which, in the closed condition of the container 10, are adapted to contact the upper beaded end wall portions 38 of the compartments of the tray member.

Figure 3:
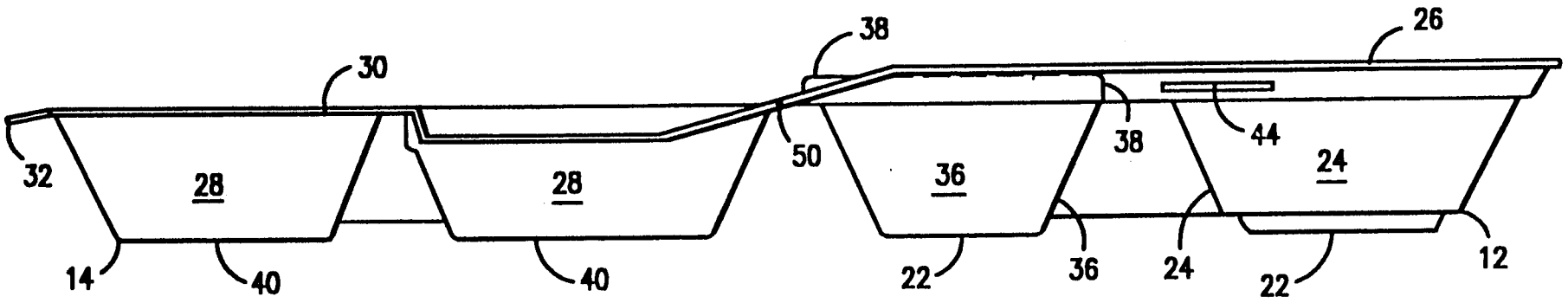
FIG. 3 illustrates a side view of the open container depicted in FIG. 2.

As is preferred in the practice of the present invention, in order to provide enhanced sealing capabilities and more secure container closure, flange structure 26 of tray member 12 is provided with latching means 48, formed in a portion of peripheral flange structure 26, for use in receiving the corresponding flange portion 30 of cover member 14 in the closed condition of container 10. A preferred location for latching means 48 is on at least one side adjacent to hinged connection 50 of the tray member 12 and cover member 14. It is particularly preferred that at least one latching means 48 be formed on each of the sides of the peripheral flange 26 adjacent to hinged connection 50. In a still more preferred embodiment of the present invention and as depicted in FIG. 3, latching means 48 comprises a curved latch body 46 having a longitudinal slit 44 therein. As can be appreciated by those skilled in the art, more than one such latching means 48 may be employed on a side adjacent hinged connection 50 of flange portion 28, depending upon the particular application. In operation, when the flange structure 30 on cover member 14 engages into slits 44 of curved latch bodies 46 of latching means 48, essentially sealed container closure is provided when the cover member 14 is closed over the tray member 12 and tabs 32 of cover member 14 engaged in slits 34.

In essence, the foregoing structure provides for an extremely rigid and sturdy container arrangement which, when the container is closed, causes the depending rib wall structure in the cover member 14 to sealingly contact the smaller compartments 18, 20 in the tray member 12, whereas the flange structure 30 on the cover member 14 will engage slits 44 of curved latch bodies 46 of latching means 48 causing sealing contact of the remainder of flange structure 30 with the interior of the flange structure 26 on the tray member 12 so as to place all of the contents in the compartments of the container 10 in an essentially sealed condition with respect to each other and the outside when the container 10 is closed and the tabs 32 are engaged into the cooperating slits 34 formed in the tray member flange structure 26.

As mentioned hereinabove, the entire container 10 may be constituted from a foamed polystyrene or any suitable moldable thermoplastic material, as is well-known in the container molding technology, and may be transparent to microwave energy so as to enable heating the contents of the container in a microwave oven while in the container.

Moreover, although the container 10 is illustrated as being essentially of a rectangular or square configuration, it becomes readily apparent to one skilled in the art that the container may be circular, oval or any multi-sided configuration. Additionally, although the tray member 12 is illustrated as possessing essentially only three compartments 16, 18 and 20, it is quite readily apparent that the container may possess two, four or even a greater number of compartments depending upon the cooperating wall and rib structure respectively molded into the tray member 12 and into the cover member 14, enabling the sealing of all of the compartments relative to each other.

From the foregoing, it becomes readily apparent to one skilled in the art that the entire container construction is extremely simple in nature and inexpensively produced so as to be adapted for mass production and economical single use or disposable utilization in so-called "fast-food" or "take-out" food retail establishments.

While there has been shown and described what is considered to be a preferred embodiment of the invention, it will, of course, be understood that various modifications and changes in form or detail could readily be made without departing from the spirit of the invention.

It is therefore intended that the invention be not limited to the exact form and detail herein shown and described, nor to anything less than the whole of the invention herein disclosed as hereinafter claimed.

What is claimed is:

1. A hinged-lid container having sealable compartments for discreetly storing and serving a plurality of foods or the like, comprising:

(a) a tray member having a plurality of compartments separated by upstanding wall portions, a bottom wall structure and a peripheral sidewall forming an encompassing tray rim;

(b) a cover member hingedly joined to said tray member along a portion of said tray rim, said cover member having a peripheral depending wall structure engageable with said tray rim to form a closed container arrangement; and (c) depending rib means formed in said cover member engageable with the surfaces of the upstanding wall portions of said tray compartments for sealing said compartments said depending rib means being in surface engaging contact with the exterior upstanding wall portions of said compartments in the closed condition of said container;

wherein said cover member and said tray member each include peripheral flange portions, at least one latching means comprising a curved latch body having a longitudinal slit therein being formed in the peripheral flange portion of said tray member on each of the sides adjacent to the hinged connection between said members for receiving the corresponding flange portion of said cover member in the closed condition of said container so as to provide a sealed container structure; said exterior upstanding wall portions of said compartments have essentially beaded upper ends extending substantially co-planar with said flange structure of said tray member; and said flange portion of said cover member includes tabs along an edge opposite the hinged connection between said members, and slit means in the flange portion of said tray member cooperatively engageable by said tabs for releasably latching said container in a closed condition.

2. The hinged-lid container of claim 1, wherein said container is of a generally rectangular configuration.

3. The hinged-lid container of claim 2, wherein said container is constituted from a foamed thermoplastic material.

4. The hinged-lid container of claim 1, wherein said container is constituted from a foamed thermoplastic material.

5. The hinged-lid container of claim 3, wherein said thermoplastic material comprises polystyrene.

6. The hinged-lid container of claim 1, wherein said thermoplastic material comprises polystyrene.

7. The hinged-lid container of claim 5, wherein said container is transparent to microwave energy.

8. The hinged-lid container of claim 1, wherein said container is transparent to microwave energy.

9. The hinged-lid container of claim 7, wherein at least one compartment of said tray member has a rib-like wavilinear bottom wall structure in order to impart additional stiffness and rigidity to said tray member.

10. The hinged-lid container of claim 1, wherein at least one compartment of said tray member has a rib-like wavilinear bottom wall structure in order to impart additional stiffness and rigidity to said tray member.

* * * * *